US011338324B2

(12) United States Patent
Pawlowski

(10) Patent No.: US 11,338,324 B2
(45) Date of Patent: May 24, 2022

(54) MICROPHONE ASSEMBLY

(71) Applicant: Knowles Electronics, LLC, Itasca, IL (US)

(72) Inventor: Andrzej Pawlowski, Virum (DK)

(73) Assignee: Knowles Electronics, LLC, Itasca, IL (US)

( * ) Notice: Subject to any disclaimer, the term of this patent is extended or adjusted under 35 U.S.C. 154(b) by 0 days.

(21) Appl. No.: 17/004,001

(22) Filed: Aug. 27, 2020

(65) Prior Publication Data

US 2021/0060608 A1 Mar. 4, 2021

Related U.S. Application Data

(60) Provisional application No. 62/892,509, filed on Aug. 27, 2019.

(51) Int. Cl.

| | |
|---|---|
| ***H04R 3/00*** | (2006.01) |
| ***B06B 1/02*** | (2006.01) |
| ***H04R 1/08*** | (2006.01) |

(52) U.S. Cl.

CPC ..... *B06B 1/0207* (2013.01); *H04R 1/08* (2013.01); *H04R 3/00* (2013.01); *H04R 2201/003* (2013.01)

(58) Field of Classification Search

CPC ..... B06B 1/0207; H04R 1/08; H04R 3/00; H04R 2201/003

USPC ..... 381/111, 123, 116, 117, 120

See application file for complete search history.

(56) References Cited

U.S. PATENT DOCUMENTS

| | | | | |
|---|---|---|---|---|
| 8,311,241 | B1 * | 11/2012 | Jordahl | H04R 3/00 381/113 |
| 2003/0025535 | A1 * | 2/2003 | Raychaudhuri | H03K 19/0005 327/108 |
| 2015/0145563 | A1 * | 5/2015 | Pardoen | G06F 13/4072 327/108 |
| 2019/0068139 | A1 * | 2/2019 | Kropfitsch | H03F 3/183 |

* cited by examiner

*Primary Examiner* — William J Deane, Jr.

(74) *Attorney, Agent, or Firm* — Loppnow & Chapa; Matthew C. Loppnow; Roland K. Bowler, II

(57) ABSTRACT

The disclosure describes devices and methods for implementing impedance matching. The device may be implemented on an integrated circuit that includes a communication protocol interface circuit, a first signal output terminal, a first output driver circuit, and a controller. The first output driver circuit is coupled to the controller and has a corresponding plurality of parallel driver stages, each driver stage including a driver and a configurable resistance coupling an output of the driver to the first signal output terminal (e.g., first contact). The configurable resistances of the first output driver form a first series terminated resistance. The controller is configured to adjust the configurable resistances to adjust the first series terminated resistance.

23 Claims, 5 Drawing Sheets

MICROPHONE ASSEMBLY

FIELD OF THE DISCLOSURE

The present disclosure relates generally to microphone assemblies including those with microelectromechanical systems (MEMS) transducers and more specifically to microphone assemblies including circuits.

BACKGROUND

Microphones having a transducer that convert sound into an electrical signal conditioned or processed by an integrated circuit are commonly integrated with cell phones, personal computers and IoT devices, among other host devices. The electrical signal is communicated with minimal attenuation if the output impedance of the microphone matches the trace impedances of the connection to the host device. However, any output impedance contributed by an integrated circuit may be subject to process and temperature variation. For example, the device-to-device resistance of on-chip series termination resistors may vary by as much as 20%. Also, depending on the application, it may be desirable to integrate the microphone into systems that excerpt different characteristic impedances.

BRIEF DESCRIPTION OF THE DRAWINGS

The objects, features and advantages of the present disclosure will become more fully apparent from the following description and appended claims, taken in conjunction with the accompanying drawings. The drawings depict only representative embodiments and are therefore not considered to limit the scope of the disclosure, the description of which includes additional specificity and detail.

DETAILED DESCRIPTION

The present disclosure describes microphone assemblies and other devices including an output driver circuit having an adjustable series terminated resistance (e.g., contributing to output impedance) at a communication interface of the microphone or other device and methods therefor. The adjustable series terminated resistance allows the output driver circuit to be adjusted or trimmed to meet a specified application requirement. The devices and methods disclosed herein may be used to reduce or eliminate manufacturing process variation and/or to match the output impedance of the microphone to the input impedance of a host device.

Figure 1:
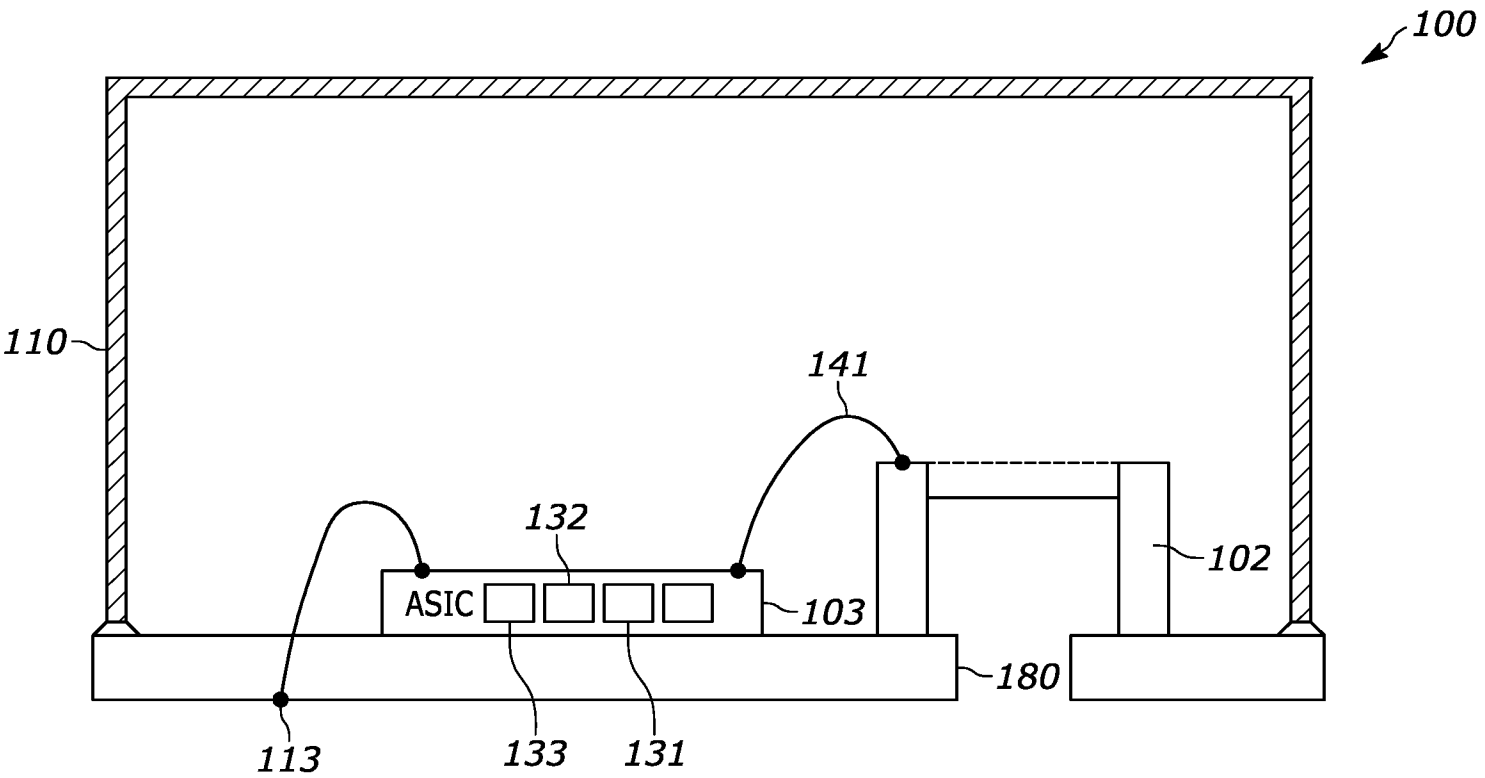
FIG. 1 is a cross-sectional view of a microphone assembly.

FIG. 1 is a cross-sectional view of a microphone assembly 100 in which adjustable output impedance is implemented. The microphone assembly generally includes an electro-acoustic transducer 102 coupled to an electric circuit 103 disposed within a housing 110. The transducer may be a capacitive, piezoelectric or other transduction device implemented using microelectromechanical systems (MEMS) fabrication or other known or future technology. The electrical circuit may be embodied by one or more integrated circuits, for example, an application specific integrated circuit (ASIC) with analog and digital circuits and a discrete digital signal processor (DSP) that performs audio processing (e.g., keyword/command detection, noise suppression, authentication . . . ). The housing 110 may include a sound port 180 and an external device interface 113 with contacts (e.g., for power, data, ground, control, external signals etc.) to which the electrical circuit is coupled. The external device interface 113 is configured for surface or other mounting to a host device (e.g., by reflow soldering).

In FIG. 1, the electric circuit 103 receives an electrical signal generated by the electro-acoustic transducer via connection 141. The signal from the transducer 102 can be processed into an output signal representative of the sensed acoustic activity by the electric circuit 103. The electric circuit 103 may include a signal processing circuit, an interface protocol circuit, a first output driver circuit, and a controller, examples of which are described below.

Figure 2:
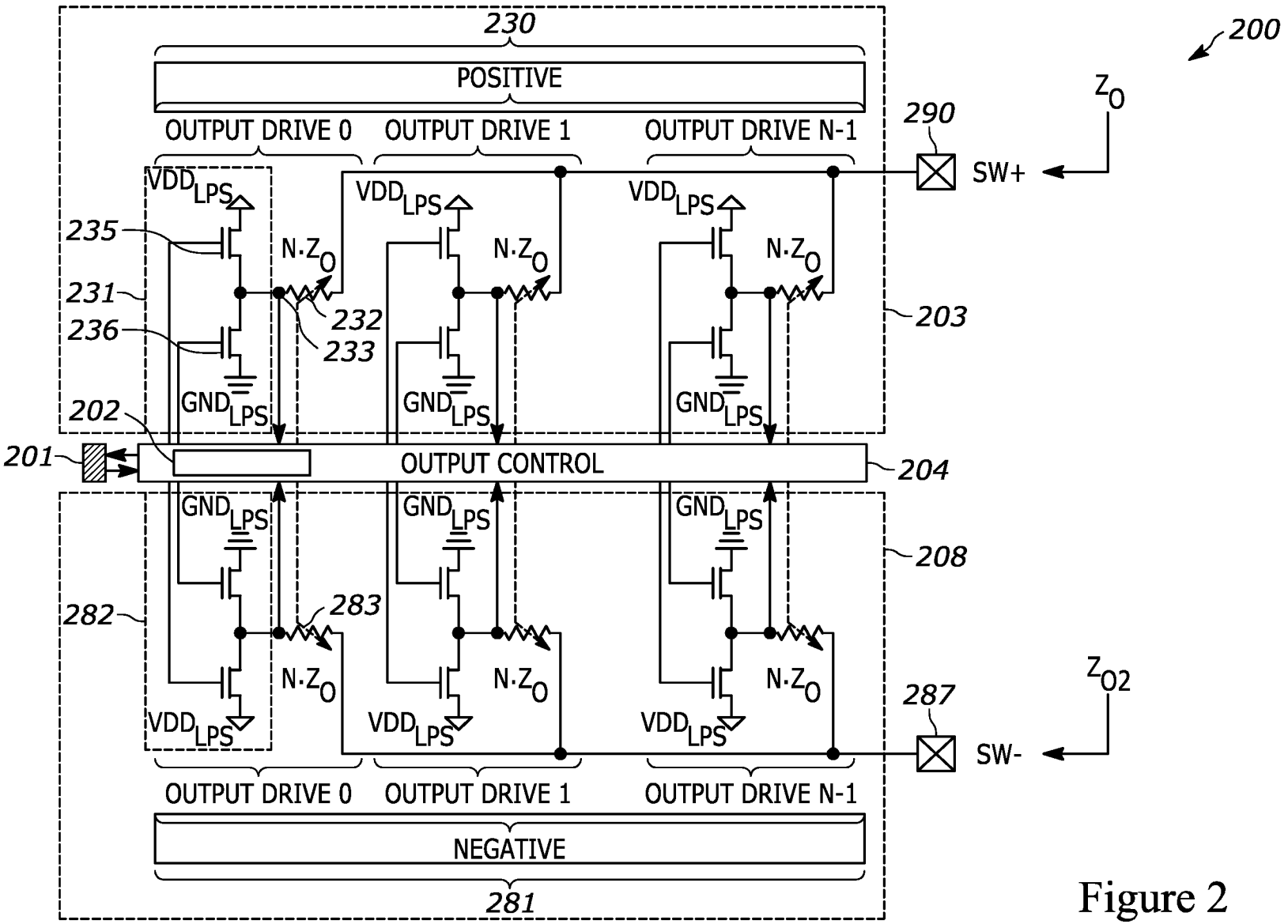
FIG. 2 is a schematic diagram of a microphone assembly driver circuit with impedance matching circuitry.

FIG. 2 is a schematic diagram of a driver circuit 200 with an adjustable output impedance implemented in an integrated circuit of a MEMS microphone or some other device having a communication interface. The driver circuit generally comprises a first output driver circuit 203, and a controller 204. In some embodiments, the driver circuit 200 also includes a second output driver circuit 208. In some implementations, the circuit 200 is with a signal processing circuit 201 and may also include an interface protocol (e.g., SoundWire, PDM, PCM among other known and future protocols) circuit 202. These and other circuits may be implemented on one or more discrete integrated circuits.

In general, the first output driver circuit 203 is arranged to send a signal to an external (e.g., host) device, for example, via the host device interface of the microphone assembly described herein. The controller 204 dictates the signal sent via the first output driver circuit 203. The interface protocol circuit 202 dictates the signal format. The controller 204 is configured to adjust an output impedance (e.g., first series terminated resistance) of the first output driver circuit 203 to meet or satisfy a specification requirement as suggested above.

The signal processing circuit 201 may be connected to an output of an electrical transducer or device that is configured to output a signal. In some embodiments, the signal processing circuit 201 may receive the signal and convert the signal from analog to digital using an analog-to-digital (A/D) converter. In other embodiments, the signal processing circuit 201 may include a buffer circuit, filter circuit, or an amplifying circuit or to filter, refine, or amplify the signal.

The interface protocol circuit 202 is connected to an output of the signal processing circuit 201. In some embodiments, the interface protocol circuit 202 and the signal processing circuit 201 may be combined into a single circuit that includes a processor and corresponding circuitry to process incoming signals and generate a corresponding output signal that adheres to a particular data exchange protocol. The interface protocol circuit 202 receives the processed signal from the signal processing circuit 201 and generates a protocol output signal to be sent. The particular protocol or format of the output signal depends generally on the application or use case and is not limiting.

The driver circuit 200 generally comprises a first output driver circuit coupled to the interface protocol circuit and having a corresponding plurality of parallel driver stages, each driver stage comprising a driver and a configurable resistance coupling an output of the driver to a first contact of the host interface, wherein the configurable resistances of the first output driver circuit form a first series terminated resistance. The circuit also comprises generally a controller coupled to the first output driver circuit and configured to adjust the first series terminated resistance by adjusting the configurable resistance of at least one driver stage of the first output driver circuit. In FIG. 2, the first output driver circuit 203 includes a plurality of driver stages 230. Each of the plurality of driver stages 230 include a driver 231 and a configurable resistance 232 that couple an output 233 of the driver 231 to a first contact 290 of the system 200. Each driver 231 may include a first transistor 235 and a second transistor 236. In this embodiment, a first terminal of the first transistor 235 is connected to voltage ($V_{DD}$), a second terminal of the first transistor 235 is connected to a first terminal of the second transistor 236, and a second terminal of the second transistor 236 is connected to a second voltage (e.g., ground). The gates of the first and second transistors 235 and 236 are connected to the controller 204. In this way, the controller 204 controls an output of the drivers 231 by controlling the gate voltages of the transistors 235 and 236. As a result, each of the drivers 231 output either the first voltage ($V_{DD}$) or the second voltage through the configurable resistance 232. In some embodiments, the first contact 290 is a host device interface of a microphone connectable to a host device. In some embodiments, the first contact 290 is an external device interface of some other device connectable to another device. In alternative embodiments, the driver 231 may implement some other circuit configuration.

The controller 204 is coupled to the first output driver circuit 203 and configured to adjust the first series terminated resistance by adjusting the configurable resistance 232 of at least one of the parallel driver stages 230. The controller 204 is connected to the configurable resistances 232, the drivers 231, and the interface protocol circuit 202. The controller 204 controls the drivers 231 to output a signal via the first contact 290 based on a signal received from the interface protocol circuit 202. The controller 204 controls the configurable resistances 232 to match an output impedance (e.g., a series terminated resistance) of the output driver circuit 203 to a specification. The resistance may be configured in a post-production process or it may be performed prior to or after integration in an OEM device.

Figure 3:
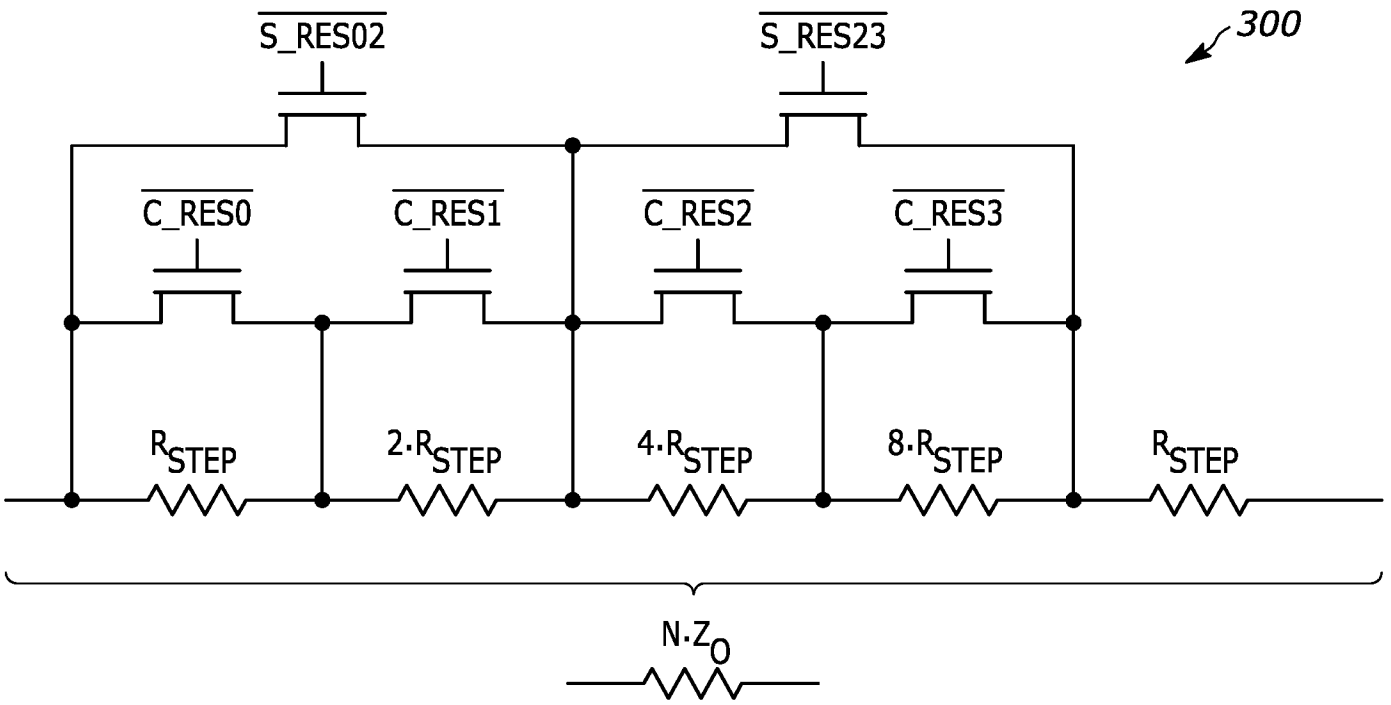
FIG. 3 is a schematic diagram of a series-terminated configurable resistor.

The configurable resistances 232 of the first output driver circuit together form a first series termination resistance (e.g., output impedance) ($Z_O$). The configurable resistances 232 have adjustable resistances. For example, FIG. 3 depicts an example of a configurable series-terminated resistor 300 corresponding to the resistance 232 of each output stage 230. The configurable series-terminated resistor of 300 includes a plurality of resistors ($R_{step}$) connected in series. The plurality of resistors $R_{step}$ may all have substantially the same resistance or different resistances. "Substantially" means within a +/−20% process variation. In one example, the plurality of resistors $R_{step}$ each have a resistance of 50 ohms. In one example, at least a portion of the plurality of resistors $R_{step}$ are connected in parallel with a corresponding transistor (e.g., c_res0, c_res1, c_res2, c_res3). For example, in one embodiment, c_res0 is connected in parallel to one $R_{step}$ resistor, c rest is connected in parallel to two series-connected $R_{step}$ resistors (or any number of resistors with an equivalent resistance of two $R_{step}$ resistors), c_res2 is connected in parallel to four series-connected $R_{step}$ resistors (or any number of resistors with an equivalent resistance of four $R_{step}$ resistors), and c_res3 is connected in parallel to eight series-connected $R_{step}$ resistors (or any number of resistors with an equivalent resistance of eight $R_{step}$ resistors). In alternative embodiments, each transistor may be connected in parallel with one $R_{step}$ resistor. In some embodiments, two or more of the transistors (e.g., c_res0, c_res1, c_res2, c_res3) are also connected in parallel with corresponding transistors (e.g., s_res01, s_res23). The gates of each corresponding transistor (e.g., c_res0, c_res1, c_res2, c_res3, and s_res01, s_res23) are connected to the controller 204. Thus, the resistance of each driver stage is configurable by controlling the gate voltage of one or more of the transistors. That is, when a voltage is applied to the gate of a corresponding transistor, the transistor effectively shorts the corresponding $R_{step}$ (or multiple $R_{steps}$) and reduces total resistance of the series-terminated configurable resistor 300.

Figure 4:
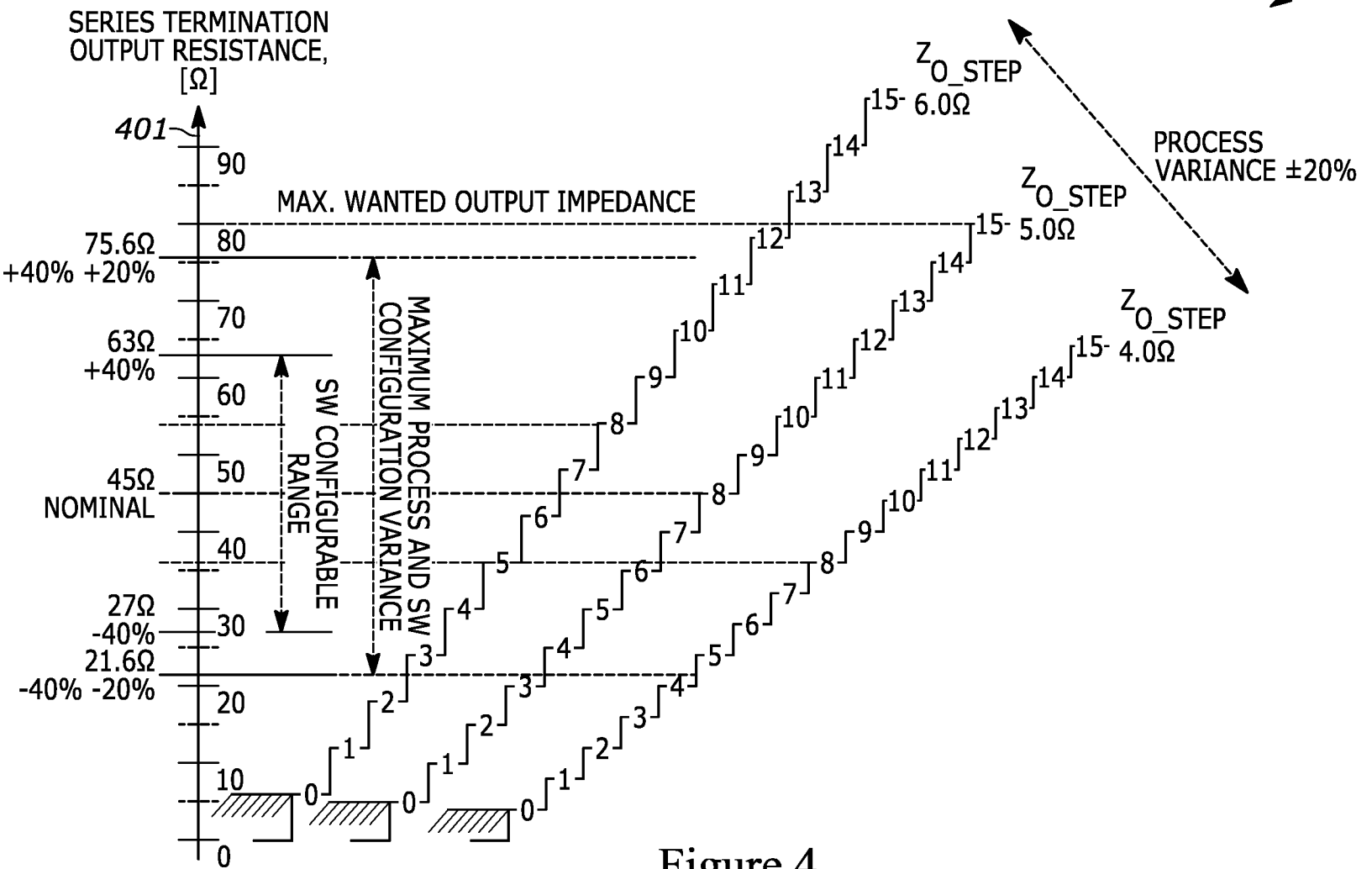
FIG. 4 is a graph showing step-wise increases of a series terminate configurable resistor.

An example of the output of one of the configurable resistances 232 is depicted in FIG. 4. FIG. 4 is a graph 400 showing step-wise increases of a series terminate configurable resistor. That is, the graph 400 depicts the series terminal output resistance 401 of one of the configurable resistances 232 as each corresponding transistor is deactivated. In this example, the configurable resistance 232 includes 16 resistors $R_{step}$. In other embodiments, the configurable resistance 232 includes 16 resistors $R_{step}$ but in other embodiments may include more or fewer than 16 resistors $R_{step}$. The process variation of implementing the resistors $R_{step}$ is about +/−20%, as a result the resistance of each configurable resistor 231 may vary depending on the manufacturing variance. However, the controller 204 can correct for these process variations by controlling the corresponding transistors and either stepping up the total resistance or stepping down the total resistance based on a measurement during a calibration stage of an actual measured resistance corresponding to each configuration of the configurable resistance 231. That is, the controller 204 is configured to adjust the resistance of each configurable resistance 231 over a step-wise linear range as depicted.

In some embodiments, the interface protocol circuit 202 is a low-voltage differential-signaling interface comprising a first output coupled to the first contact 290 and a second output coupled to a second contact 287. In such an embodiment, the microphone assembly 200 also includes a second output driver circuit 208 having a corresponding second plurality of parallel driver stages 281, each of the second driver stages 281 including a driver 282 and a configurable resistance 283 coupling an output of the respective second driver 282 and the second contact 287. The configurable resistances 283 of the second output driver circuit form a second series termination resistance ($Z_{O2}$). The controller 204 is connected to a second output driver circuit and designed to adjust the second series terminated resistance by adjusting the configurable resistance of at least one driver stage of the second output driver circuit in the manner described herein. The controller 204 adjusts the second series terminated resistance to match an impedance of a device connected to the second contact 287.

Figure 5:
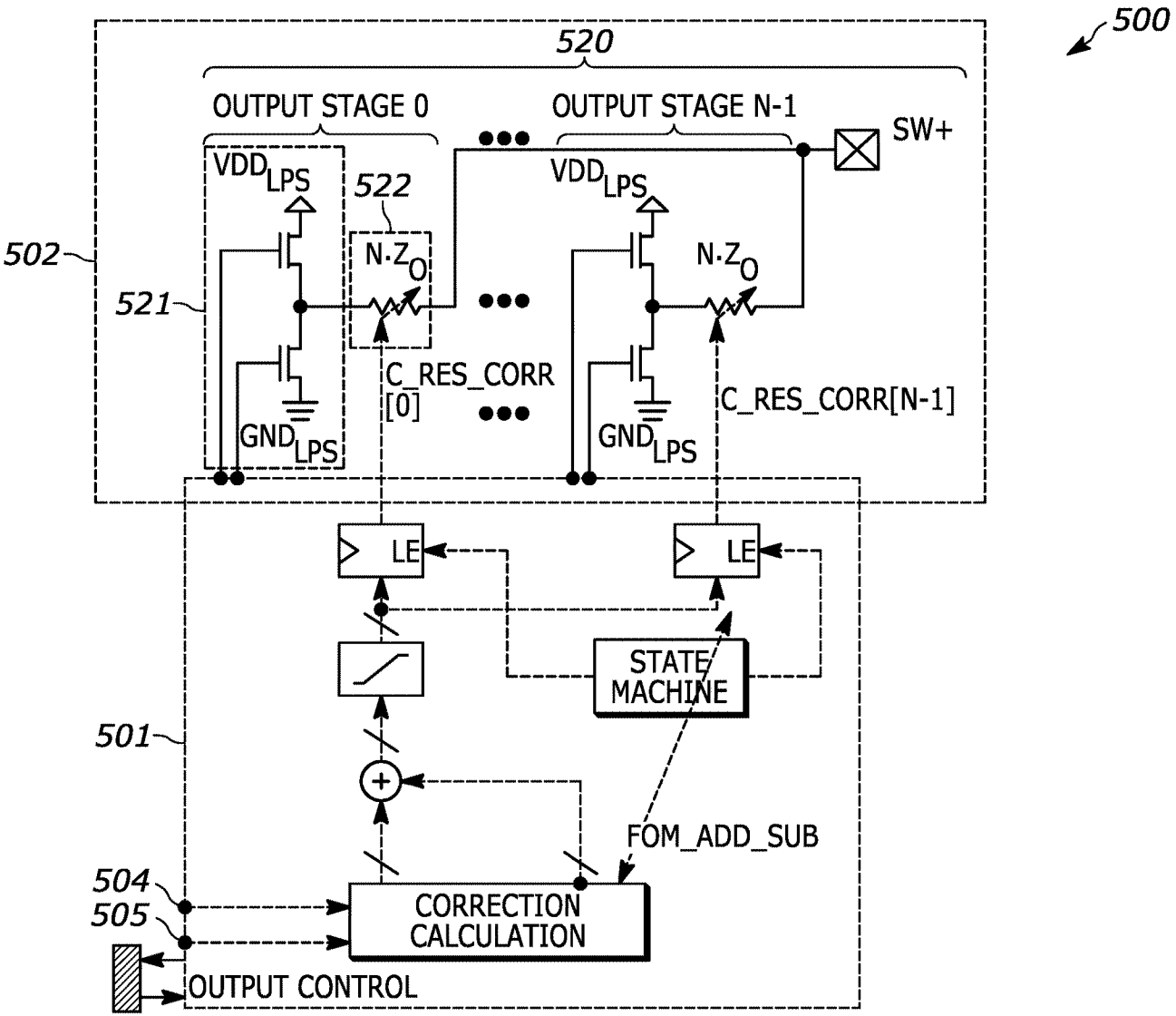
FIG. 5 is a block diagram of a state machine for implementing impedance matching.

FIG. 5 is a block diagram 500 of a state machine for a system implementing impedance matching. The block diagram 500 includes a state machine of a controller 501 and an output driver circuit 502. The output driver circuit 502 includes a plurality of parallel output driver stages 520. Each of the plurality of parallel output driver stages 520 include a driver 521 and a configurable resistance 522.

The controller 501 includes a processor and a memory, in some implementations. The controller 501 receives or accesses a process error indication 504. The process error indication 504 may be stored in the memory on the controller 501. In some embodiments, the process error indication 504 is determined by a wafer-test machine during a calibration stage after the configurable resistances 522 were manufactured. In some embodiments, the process error indication 504 was determined by the controller 501 during a calibration stage. The calibration stage may have determined the amount of resistance that each configurable resistance 232 was supposed to have in different states vs the actual amount of resistance that each configurable resistance 232 in those different stages. The controller 501 also receives an indication 505 of an input impedance of a corresponding device connected to a first contact 590 is and what the impedance of the series terminated resistance should be set to. The controller 501 then adjusts the resistance of each of the configurable resistances 522 to ensure that the output impedance of the output driver circuit 502 is substantially the same as the received input impedance. The controller uses the process error indication 504 to further adjust the configurable resistances 522 in order to compensate for the process error of the resistors and ensure that the series terminal resistance is closely matched to the received indication 505 of the input impedance.

The foregoing description of illustrative embodiments has been presented for purposes of illustration and of description. It is not intended to be exhaustive or limiting with respect to the precise form disclosed, and modifications and variations are possible in light of the above teachings or may be acquired from practice of the disclosed embodiments. It is intended that the scope of the invention be defined by the claims appended hereto and their equivalents.

What is claimed is:

1. A digital microphone assembly configured to be integrated with a host device, the assembly comprising:

a housing having a host interface;

a microelectromechanical systems (MEMS) transducer disposed in the housing; and an integrated circuit disposed in the housing, the integrated circuit comprising:

a signal processing circuit coupled to an output of the transducer;

an interface protocol circuit coupled to an output of the signal processing circuit;

a first output driver circuit coupled to the interface protocol circuit and having a corresponding plurality of parallel driver stages, each driver stage comprising a driver and a configurable resistance coupling an output of the driver to a first contact of the host interface, wherein the configurable resistances of the first output driver circuit form a first series terminated resistance; and a controller coupled to the first output driver circuit and configured to adjust the first series terminated resistance by adjusting the configurable resistance of at least one driver stage of the first output driver circuit.

2. The assembly of claim 1, wherein the configurable resistance of each driver stage comprises a plurality of resistors connected in series, one or more the plurality of resistors connected in parallel with a corresponding transistor, wherein the controller is coupled to and configured to control each transistor, wherein the resistance of each driver stage is adjustable by controlling at least one transistor of the corresponding driver stage.

3. The assembly of claim 2, wherein the controller is configured to adjust the resistance of each driver stage differently.

4. The assembly of claim 2, wherein the controller is configured to independently control each transistor to effectively short circuit the corresponding resistor.

5. The assembly of claim 1, wherein the interface protocol circuit is a low-voltage differential-signaling interface comprising a first output coupled to the first contact and a second output coupled to a second contact of the host interface;

a second output driver circuit having a corresponding second plurality of parallel driver stages, each of the second driver stages comprising a driver and a configurable resistance coupling an output of the respective second driver and the second contact, wherein the configurable resistances of the second output driver circuit form a second series termination resistance, the controller coupled to the second output driver circuit and configured to adjust the second series terminated resistance by adjusting the configurable resistance of at least one driver stage of the second output driver circuit.

6. The assembly of claim 5, wherein the configurable resistance of each driver stage comprises a second plurality of resistors connected in series, one or more of the plurality of resistors connected in parallel with a corresponding transistor, the controller coupled to each of the second plurality of transistors and configured to control each transistor, wherein the resistance of each of the second plurality of driver stages is adjustable by controlling at least one transistor of the corresponding driver stage.

7. An integrated circuit for a micro-electro-mechanical systems (MEMS) microphone assembly, the integrated circuit comprising:

a first signal output terminal connectable to an external device interface of a MEMS microphone assembly;

a first output driver circuit having a corresponding plurality of parallel driver stages, each driver stage comprising a driver and a configurable resistance coupling an output of the driver to the first signal output terminal, wherein the configurable resistances of the first output driver circuit form a first series terminated resistance; and a controller coupled to the first output driver circuit and configured to adjust the first series terminated resistance by adjusting the configurable resistance of at least one driver stage of the first output driver circuit.

8. The integrated circuit of claim 7, wherein the configurable resistance of each driver stage comprises a plurality of resistors connected in series, one or more of the plurality of resistors connected in parallel with a corresponding transistor, wherein the controller is coupled to each of the plurality of transistors and configured to independently control each transistor, wherein the resistance of each driver stage is adjustable by controlling at least one transistor of the corresponding driver stage.

9. The integrated circuit of claim 7, wherein the controller is configured to adjust the resistance of each driver stage differently.

10. The integrated circuit of claim 7, wherein the controller is configured to control each transistor by applying a gate voltage to the corresponding transistor, wherein the gate voltage turns ON the transistor and effectively short circuits the resistor.

11. The integrated circuit of claim 7, wherein a resistance of each of the plurality of resistors is substantially the same.

12. The integrated circuit of claim 7, wherein the controller is configured to adjust the resistance of each driver stage over a step-wise linear range.

13. The integrated circuit of claim 7 further comprising:

a low-voltage differential-signaling interface comprising the first signal output terminal and a second signal output terminal;

a second output driver circuit having a corresponding second plurality of parallel driver stages, each driver stage comprising a driver and a configurable resistance coupling an output of the driver and the second signal output terminal, wherein the configurable resistances of the second output driver circuit form a second series terminated resistance, the controller coupled to the second output driver circuit and configured to adjust the second series terminated resistance by adjusting the resistance of at least one driver stage of the second output driver circuit.

14. The integrated circuit of claim 13, wherein the configurable resistance of each of the second plurality of driver stages comprises a second plurality of resistors connected in series, one or more of the plurality of resistors connected in parallel with a corresponding transistor, wherein the controller is coupled to each of the plurality of transistors and configured to independently control each transistor, wherein the resistance of each driver stage is adjustable by controlling the corresponding transistor.

15. The assembly of claim 1, wherein the first output driver circuit outputs a signal via the host interface based on a signal received from the MEMS transducer.

16. An integrated circuit, comprising:

a communication protocol interface circuit;

a first signal output terminal;

a first output driver circuit having an input coupled to the communication protocol interface circuit, the first output driver circuit having a corresponding plurality of parallel driver stages, each driver stage comprising a driver and a configurable resistance between an output of the driver and the first signal output terminal, wherein the configurable resistances of the first output driver circuit form a first series terminated resistance coupling the first output driver circuit to the first signal output terminal; and a controller coupled to the first output driver circuit and configured to adjust the first series terminated resistance by adjusting the configurable resistance of at least one driver stage of the first output driver circuit, wherein an impedance at the first signal output terminal is configurable by adjusting the first series terminated resistance.

17. The integrated circuit of claim 16, the configurable resistance of each driver stage comprising a plurality of resistors connected in series, one or more of the plurality of resistors connected in parallel with a corresponding transistor, the controller coupled to and configured to independently control each transistor, wherein the resistance of each driver stage is adjustable by controlling at least one transistor of the corresponding driver stage.

18. The integrated circuit of claim 17, wherein the controller is configured to adjust the resistance of each driver stage differently.

19. The integrated circuit of claim 17, wherein the controller is configured to control each transistor by applying a gate voltage to the corresponding transistor, wherein the gate voltage turns ON the transistor and effectively short circuits the resistor.

20. The integrated circuit of claim 17, wherein the controller is configured to adjust the resistance of each driver stage over a step-wise linear range.

21. The integrated circuit of claim 16 further comprising:

a low-voltage differential-signaling interface comprising the first signal output terminal and a second signal output terminal;

a second output driver circuit having a corresponding plurality of parallel driver stages, each driver stage comprising a driver and a configurable resistance coupling an output of the driver to the second signal output terminal, wherein the configurable resistances of the second output driver circuit form a second series terminated resistance, the controller coupled to the second output driver circuit and configured to adjust the second series terminated resistance by adjusting the resistance of at least one driver stage of the second output driver circuit.

22. The integrated circuit of claim 21, the configurable resistance of each driver stage comprising a plurality of resistors connected in series, one or more of the plurality of resistors connected in parallel with a corresponding transistor, the controller coupled to each of the plurality of transistors and configured to independently control each transistor, wherein the resistance of each driver stage is adjustable by controlling at least one transistor of the corresponding driver stage.

23. The integrated circuit of claim 16, wherein the first output driver circuit outputs a signal via the signal output terminal based on a signal received from a transducer.

* * * * *